US012774143B2

(12) United States Patent
Ma et al.

(10) Patent No.: US 12,774,143 B2
(45) Date of Patent: Oct. 27, 2026

(54) PROTECTIVE PACKAGING ASSEMBLY

(71) Applicant: NewAge Products Inc., Toronto (CA)

(72) Inventors: Wing Hong (Aaron) Ma, Richmond Hill (CA); Naishadh Jhaveri, Mumbai (IN); Manojkumar Sivaprahasam, Tamil Nadu (IN)

(73) Assignee: NewAge Products Inc., Toronto (CA)

( * ) Notice: Subject to any disclaimer, the term of this patent is extended or adjusted under 35 U.S.C. 154(b) by 22 days.

(21) Appl. No.: 19/089,959

(22) Filed: Mar. 25, 2025

(65) Prior Publication Data

US 2026/0296759 A1 Oct. 1, 2026

(51) Int. Cl.
*B65D 81/02* (2006.01)
*B65D 5/50* (2006.01)

(52) U.S. Cl.
CPC ..... *B65D 81/02* (2013.01); *B65D 5/5033* (2013.01)

(58) Field of Classification Search
CPC .... B65D 81/02; B65D 81/053; B65D 81/054; B65D 5/5033
USPC ..... 206/586
See application file for complete search history.

(56) References Cited

U.S. PATENT DOCUMENTS 3,835,986 A * 9/1974 Le Beau ..... B65D 75/004 217/65
6,357,587 B1 * 3/2002 Melms, Jr. ..... B65D 85/64 206/326
7,727,614 B2 * 6/2010 Stubing ..... B65D 81/053 229/199
9,598,217 B2 3/2017 Giller
11,352,188 B2 6/2022 Reynolds et al.
2013/0032506 A1 * 2/2013 Grenchus, Jr. ..... B65D 81/056 53/396

(Continued)

FOREIGN PATENT DOCUMENTS

CN 208516083 U 2/2019
CN 216036342 U 3/2022

(Continued)

OTHER PUBLICATIONS

English language abstract for CN 208516083 U extracted from espacenet.com database on Mar. 26, 2025, 1 page.

(Continued)

*Primary Examiner* — Jacob K Ackun
(74) *Attorney, Agent, or Firm* — Howard & Howard Attorneys PLLC

(57) ABSTRACT

A protective packaging assembly for protecting cargo from damage during transport or handling. The protective packaging assembly includes a plurality of corner protectors spaced apart from one another with each corner protector having a first end, a second end, and a length therebetween. The prospective packaging assembly also includes a plurality of corner pads disposed on each corner protector of the plurality of corner protectors along the length. The plurality of corner pads on each corner protector are spaced from each other to define one or more gaps along the length of each corner protector to define a mounting portion of the corner protector. The protective packaging assembly further includes at least one reinforcement bar disposed in one of the gaps and in direct contact with the mounting portion of a corresponding corner protector.

22 Claims, 15 Drawing Sheets

(56) References Cited

U.S. PATENT DOCUMENTS

| | | | | |
|---|---|---|---|---|
| 2017/0283153 | A1* | 10/2017 | Fujihara | B65D 81/054 |
| 2025/0136344 | A1* | 5/2025 | Yamada | B65D 81/054 |

FOREIGN PATENT DOCUMENTS

| | | | |
|---|---|---|---|
| DE | 2646908 | A1 | 4/1978 |
| KR | 20050074132 | A | 7/2005 |
| KR | 101320411 | B1 | 10/2013 |
| KR | 101505565 | B1 | 3/2015 |
| PL | 129538 | U1 | 3/2021 |

OTHER PUBLICATIONS

English language abstract for CN 216036342 U extracted from espacenet.com database on Mar. 26, 2025, 1 page.
Machine-assisted English language translation for KR 20050074132 A extracted from espacenet.com database on Mar. 26, 2025, 4 pages.
English language abstract for KR 101320411 B1 extracted from espacenet.com database on Mar. 26, 2025, 1 page.
English language abstract for KR 101505565 B1 extracted from espacenet.com database on Mar. 26, 2025, 1 page.
English language abstract for PL 129538 U1 extracted from espacenet.com database on Mar. 26, 2025, 1 page.

* cited by examiner

PROTECTIVE PACKAGING ASSEMBLY

BACKGROUND

Protective packaging is commonly used to safeguard cargo during transportation. Some cargo, especially those moved using machinery, can still suffer damage. Machines with clamping mechanisms often harm the cargo despite the presence of protective packaging. These mechanisms can leave impressions or cause significant damage, rendering the cargo unusable. Protective packaging that utilizes cardboard are designed to protect against impact but does not specifically address damage from the equipment used in transportation.

As such, there remains a need in the art for packaging that overcomes at least some of the disadvantages mentioned above.

SUMMARY

According to a first aspect, a protective packaging assembly for protecting cargo from damage during transport or handling is presented. The protective packaging assembly includes a plurality of corner protectors spaced apart from one another with each corner protector having a first end, a second end, and a length therebetween. The protective packaging assembly includes a plurality of corner pads disposed on each corner protector of the plurality of corner protectors along the length. The plurality of corner pads on each corner protector are spaced apart from each other to define one or more gaps along the length of each corner protector to define a mounting portion of the corner protector. The protective packaging assembly includes at least one reinforcement bar disposed in one of the gaps and in direct contact with the mounting portion of a corresponding corner protector.

According to a second aspect, a method of installing a protective packaging assembly for protecting cargo is presented. The method includes the steps of positioning the plurality of corner protectors spaced apart from one another about the cargo. The method also includes the steps of disposing the plurality of corner pads on each corner protector of the plurality of corner protectors such that the plurality of corner pads on each corner protector are spaced from each other to define one or more gaps and to define a mounting portion of the corner protector. The method further includes the steps of mounting the at least one reinforcement bar in one of the gaps and in direct contact with the mounting portion of a corresponding corner protector.

BRIEF DESCRIPTION OF THE DRAWINGS

Advantages of the present invention will be readily appreciated as the same becomes better understood by reference to the following detailed description when considered in connection with the accompanying drawings.

DETAILED DESCRIPTION

Figure 1:
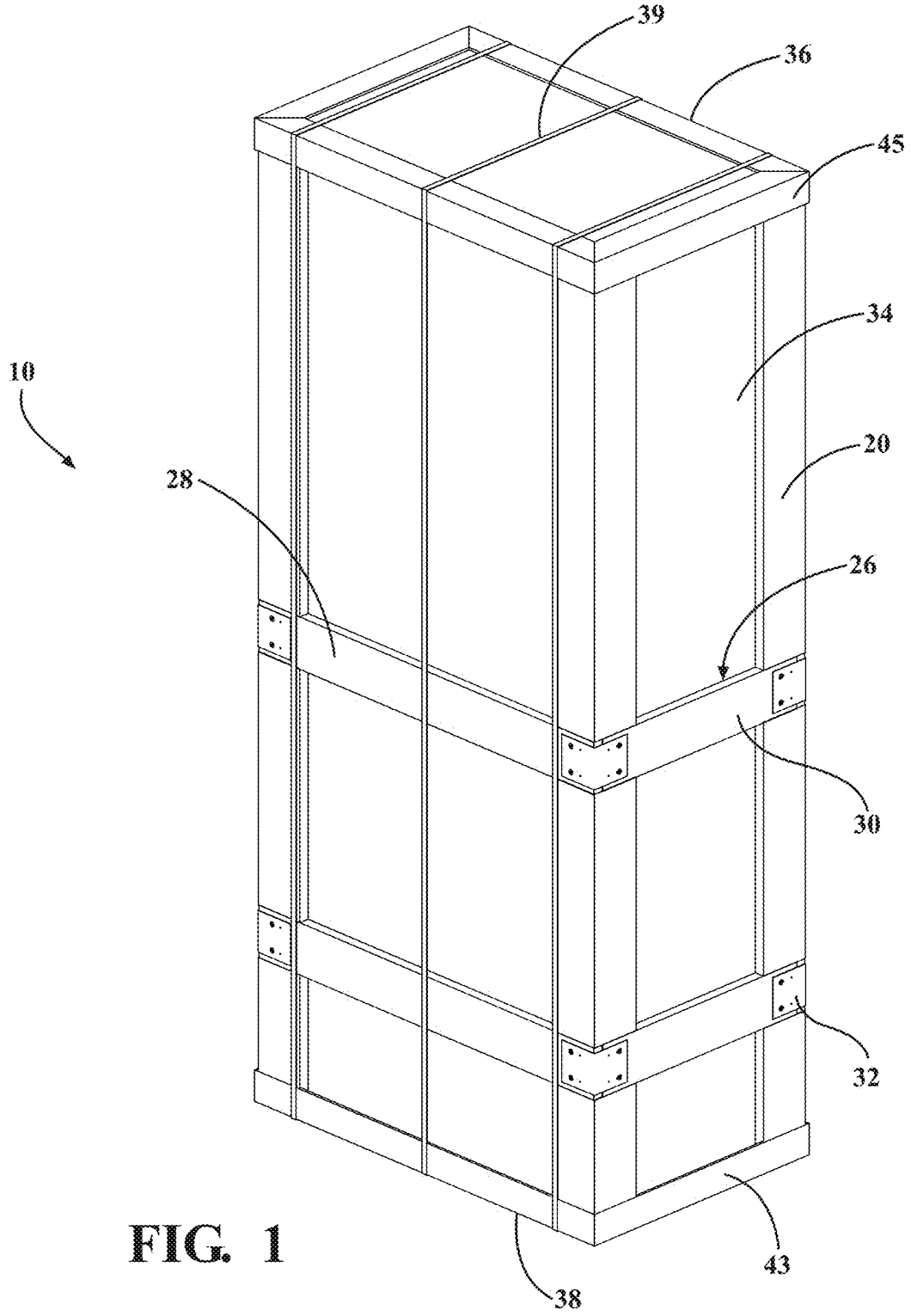
FIG. 1 is a perspective view of a protective packaging assembly.

Referring to the FIGS. 1, 2 and 8-10, wherein like numerals indicate like parts throughout the several views, a protective packaging assembly 10 is shown. The protective packaging assembly 10 protects cargo 11 from damage during transport or while being handled. The cargo 11 may have different shapes and sizes and as a result the protective packaging assembly 10 may be configured to accommodate these differences. Said differently, various cargo 11 may have different lengths and/or widths and the protective packaging assembly 10 may be formed accordingly about the cargo to accommodate these differences. It should also be appreciated that the cargo 11 may have a rigid exterior and a flush or irregular exterior.

Referring also to FIGS. 3 and 5-7, the protective packaging assembly 10 includes a plurality of corner protectors 12 that are spaced apart from one another with each corner protector 12 having a first end 14, a second end 16, and a length L therebetween. The first end 14 and second end 16 can be identical. It should also be appreciated that the length L represents the distance between the first end 14 and the second end 16. Each corner protector 12 of the plurality of the corner protectors 12 includes a first panel 40 coupled to a second panel 42 angled to form a corner. The combination of the first panel 40 and the second panel 42 forms an interior 53 and an exterior 54 of each corner protector 12. When the plurality of corner protectors 12 are placed about the cargo 11, the interior 53 of the corner protector 12 is in contact with the exterior of the cargo 11. Each corner protector 12 may form a ninety-degree angle. Also, each corner protector 12 may form an angle greater or less than ninety-degrees. In certain implementations the corner protector 12 may also form other shapes such as a curved shape. The plurality of corner protectors 12 may include the combination of each corner protector 12 having a different shape. For example, the plurality of corner protectors 12 can include the ninety-degree angle and the curved shape. In certain implementations the plurality of corner protectors 12 may comprise compressed cardboard. However, it should be appreciated that the plurality of corner protectors 12 may be of any suitable material such as foam or wood.

Figure 4:
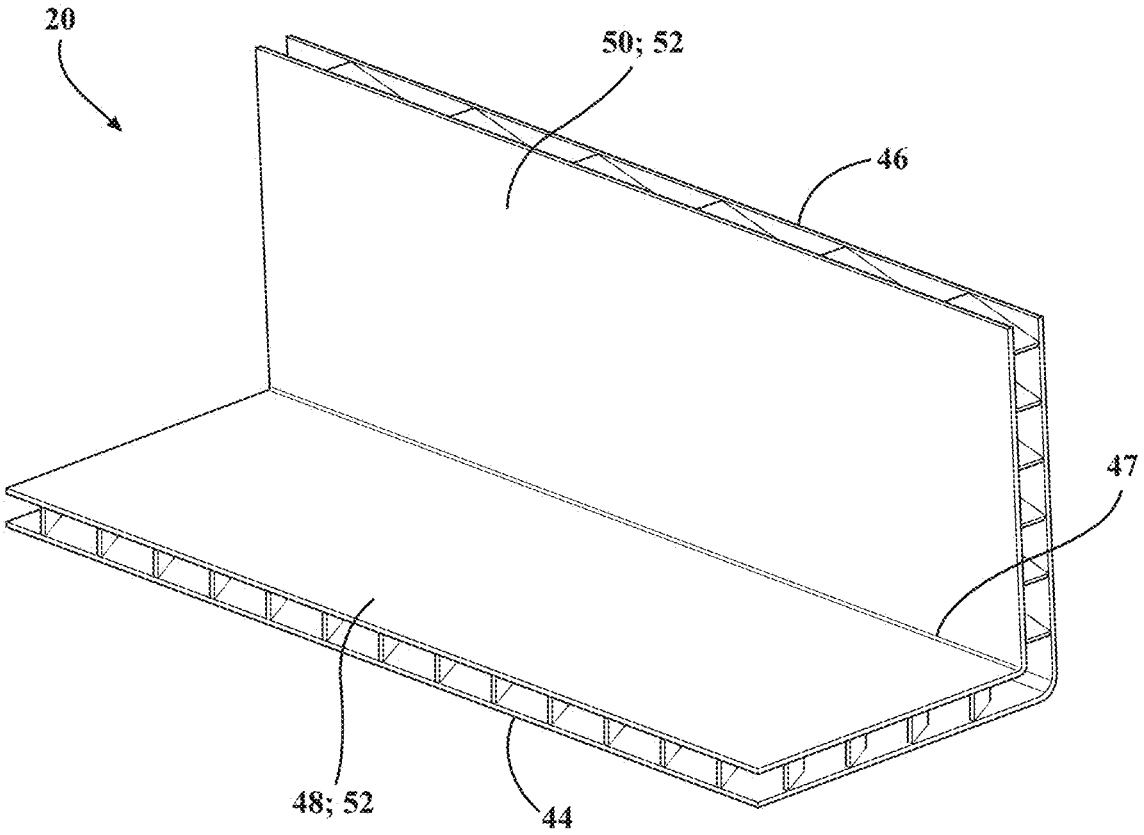
FIG. 4 is a perspective view of one of the corner pads.
Figure 5:
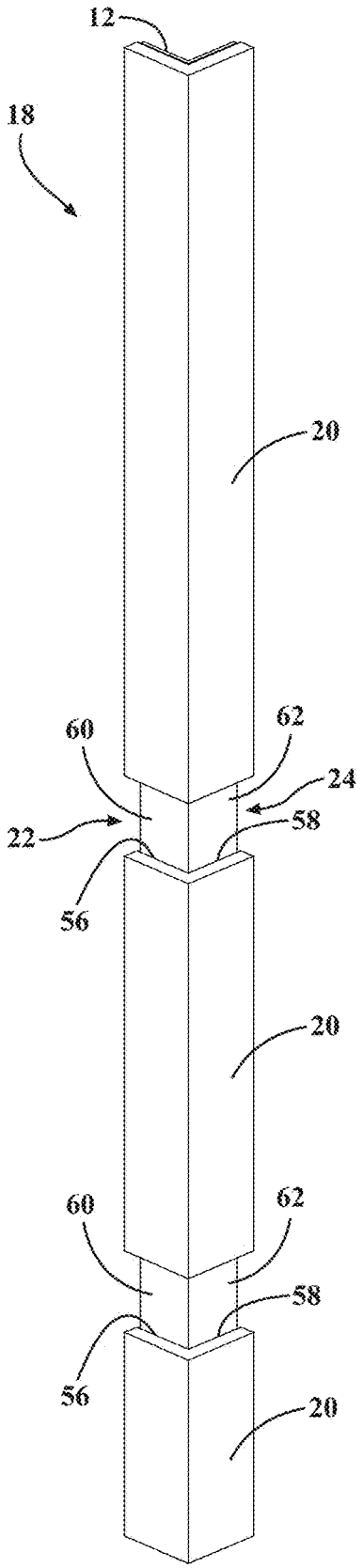
FIG. 5 is a perspective view of the plurality of corner pads mounted to the corner protector to create a corner sub-assembly of the protective packaging assembly.
Figure 6:
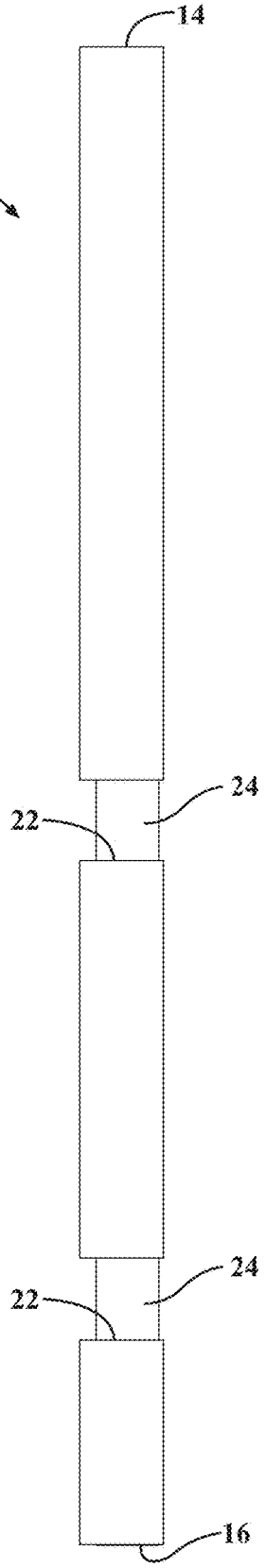
FIG. 6 is an elevation view of the corner sub-assembly.
Figure 7:
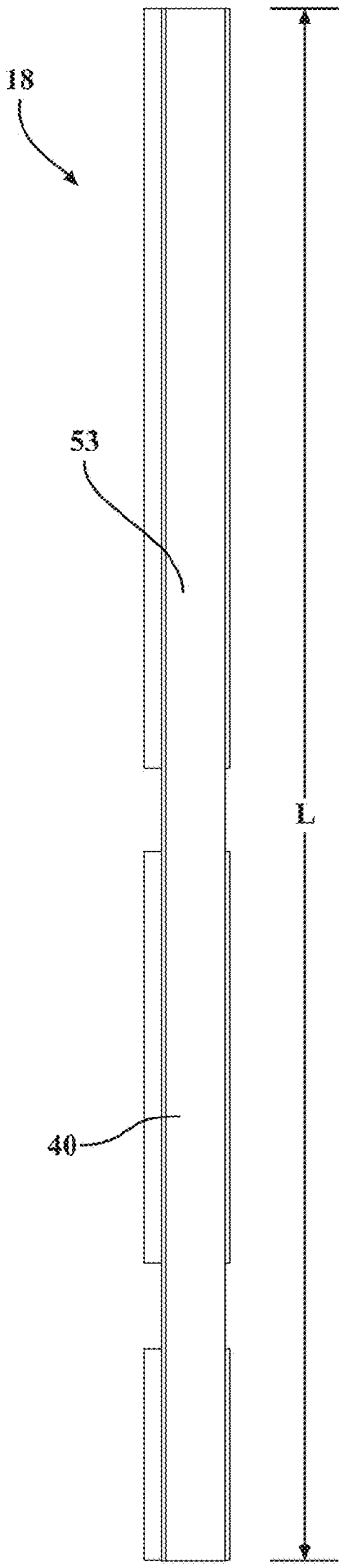
FIG. 7 is another elevation view of the corner sub-assembly.

As also shown in FIG. 4, the protective packaging assembly 10 also includes a plurality of corner pads 20 that are disposed on each corner protector 12 of the plurality of corner protectors 12 along the length L of the corner protector 12. In other words, each corner protector 12 includes at least two corner pads 20. The plurality of corner pads 20 that are on each corner protector 12 are spaced from each other to define one or more gaps 22 along the length L of each corner protector 12 to define a mounting portion 24 of the corner protector 12. Said differently, the mounting portion 24 of the corner protector 12 extends between two adjacent corner pads 20 that are spaced apart to define the one or more gaps 22. It should be appreciated that one or more gaps 22 may include one gap 22 or at least two gaps 22.

In one embodiment, the plurality of corner pads 20 are fixedly mounted to each corner protector 12 to maintain the one or more gaps 22. It should be appreciated that the plurality of corner pads 20 may be fixedly mounted to each corner protector 12 in different ways. In certain implementations the plurality of corner pads 20 are mounted to each corner protector 12 by an adhesive, which will be described in further detail later. It is advantageous to use the adhesive as it may be cost effective and reduce a weight of the protective packaging assembly 10. In alternative implementations the plurality of corner pads 20 can be mounted to each corner protector 12 by a fastener such a staple. The plurality of corner pads 20 may be configured with different sizes along the length L. For example, the corner pad 20 may be fixedly mounted adjacent the second end 16 and may be longer than the corner pad 20 fixedly mounted adjacent the first end 14. The corner pads 20 may be the same size as other corner pads 20 along the length L of the corner protector 12. It is advantageous to have different sized corner pads 20 as a height of the cargo 11 can change. In certain implementations the plurality of corner pads 20 are comprised of honeycomb cardboard as shown in FIG. 4. It should be appreciated that the plurality of corner pads 20 may be made of any suitable material, such as foam, and specifically from EPS foam. Each corner pad 20 of the plurality of corner pads 20 includes a first portion 44 disposed on the first panel 40 and a second portion 46 disposed on the second panel 42. A fold 47 in a middle of each corner pad 20 may divide the first and second portion 44, 46 into the two parts, which may make up each corner pad 20. It should be appreciated that the fold 47 may be rounded to form a curve or sharp to form a crease. The first and second portion 44, 46 may be the same length or different lengths. For example, the first portion 44 can be longer than the second portion 46 or the second portion 46 can be longer than the first portion 44.

As best shown in FIG. 4, the first portion 44 of the corner pads 20 includes a first inner face 48 and the second portion 46 of the corner pads 20 includes a second inner face 50 with the first inner face 48 abutting the second inner face 50 to form an interior 52 of each corner pad 20 of the plurality of corner pads 20. The interior 52 of each corner pad 20 of the plurality of the panels 40, 42 of corner pads 20 are disposed on the exterior 54 of the plurality of corner protectors 12. The adhesive may be applied to the interior 52 of the corner pad 20 to facilitate fixedly mounting the corner pad 20 to the corner protector 12. It should be appreciated that the adhesive is not required to go on the interior 52 first to fixedly mount the corner pads 20 to the corner protectors 12.

Figure 2:
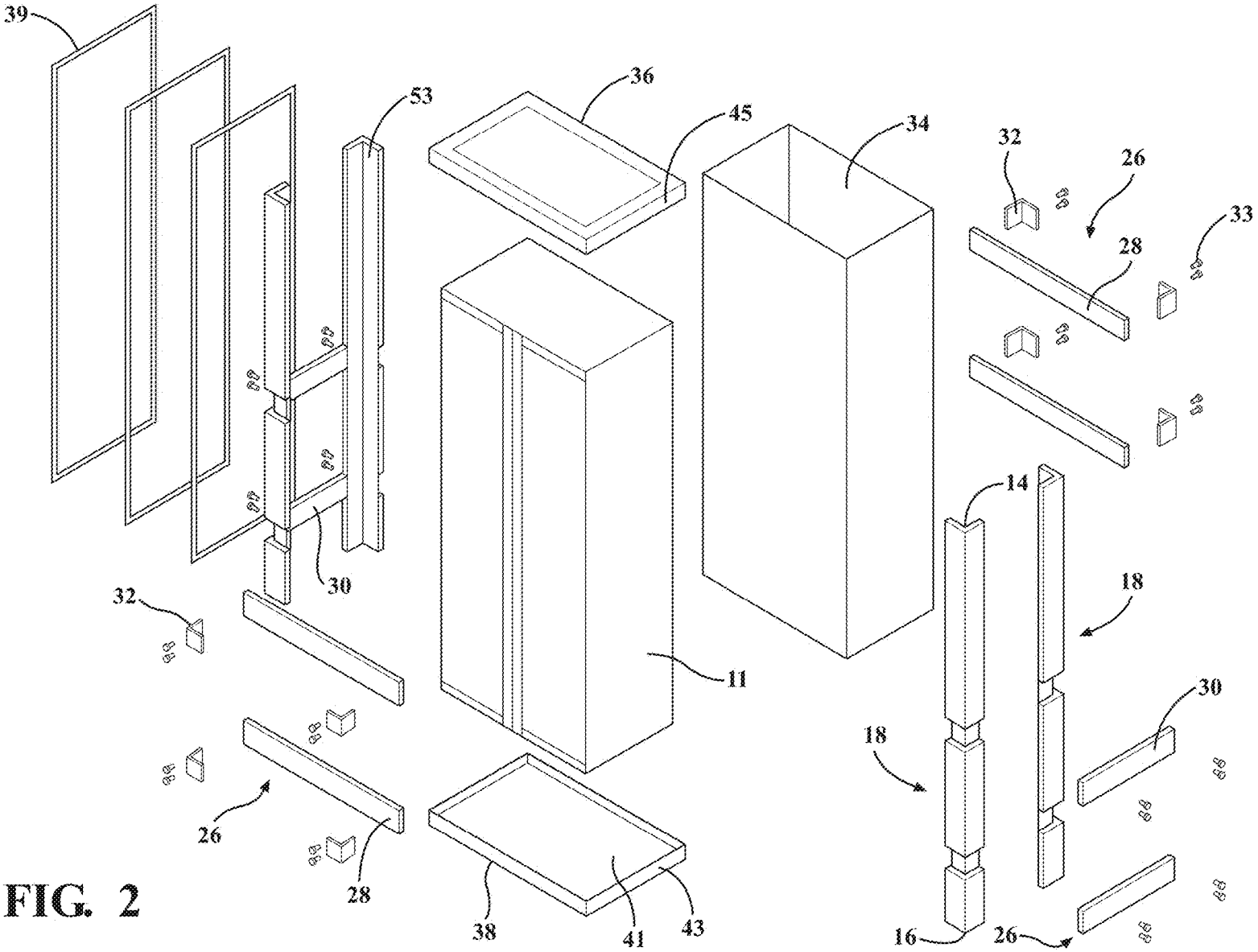
FIG. 2 is an exploded view of the protective packaging assembly.
Figure 3:
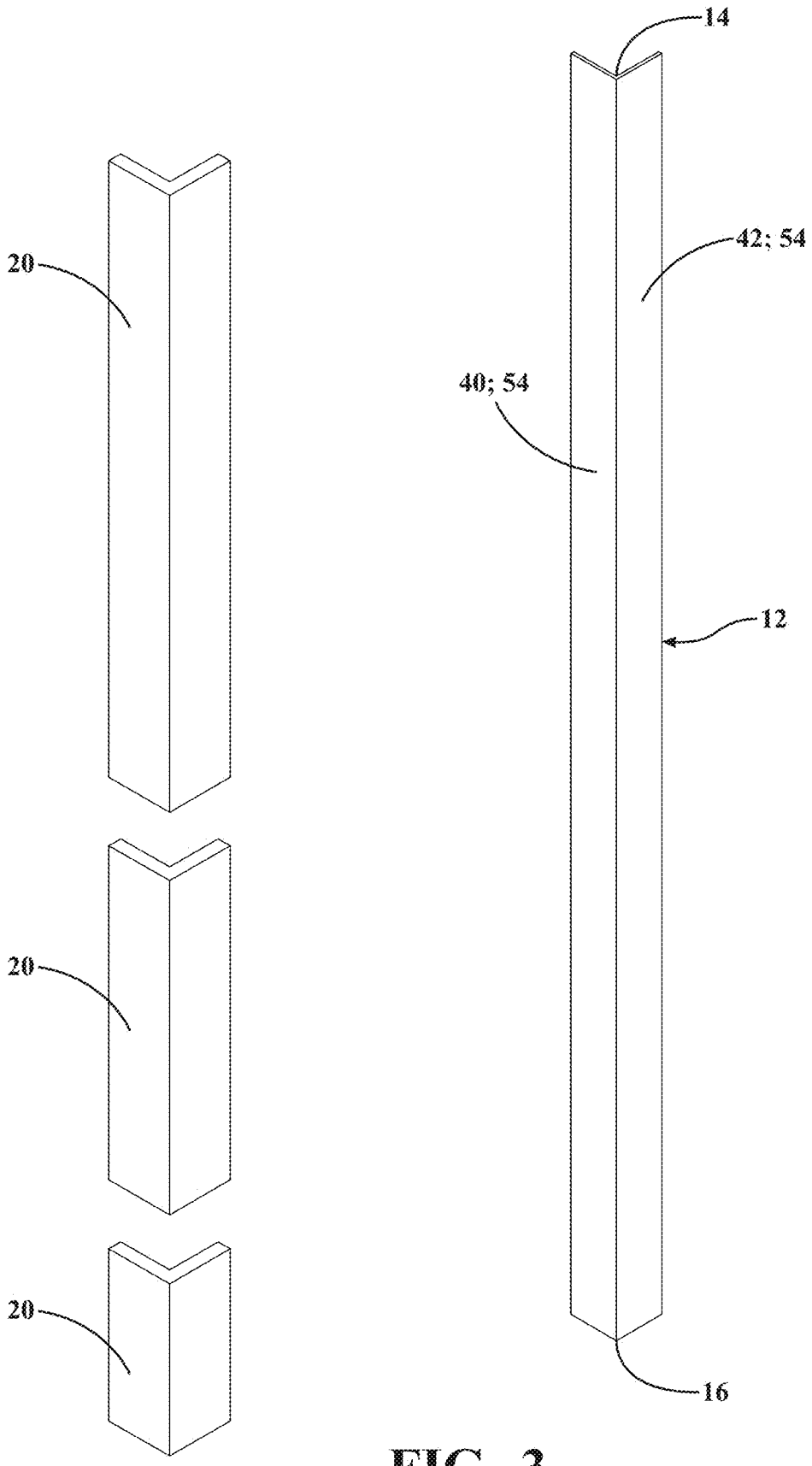
FIG. 3 is an exploded view of a corner protector and a plurality of corner pads.

As shown in FIGS. 2 and 5-7, the one or more gaps 22 are further defined as a first gap 56 and a second gap 58 to define a first mounting portion 60 and a second mounting portion 62 on a corresponding corner protector 12. It should be appreciated that the one or more gaps 22 are formed from the spacing of the plurality of corner pads 20 along the length L of the corner protector 12. In other words, a gap 22 is formed between any two corner pads 20. For example, if the corner protector 12 has five corner pads 20, there are eight gaps 22 along the length L of the corner protector 12. Additionally, it should be appreciated that the first and second mounting portion 60, 62 may be further defined as the section on the corner protector 12 and between the gaps 22. As shown in FIGS. 1 and 2, the protective packaging assembly 10 may include four corner protectors 12 with the plurality of corner pads 20 may be further defined as three pads 20 for each corner protector 12 such that four gaps 22 are defined along the length L of each corner protector 12 to define a total of sixteen gaps 22.

A corner sub-assembly 18 is formed when the plurality of corner pads 20 are fixedly mounted to the corner protector 12. In other words, the corner protector 12 and its adhered corner pads 20 form a unitary unit called a corner sub-assembly 18. Preferably, the corner pads 20 are mounted to the corner protector 12 to form the corner sub-assembly 18 prior to being installed about the cargo 11. It should be appreciated that because each corner protector 12 is a part of the corner sub-assembly 18, the corner sub-assembly 18 has the same first and second end 14, 16.

Figure 20:
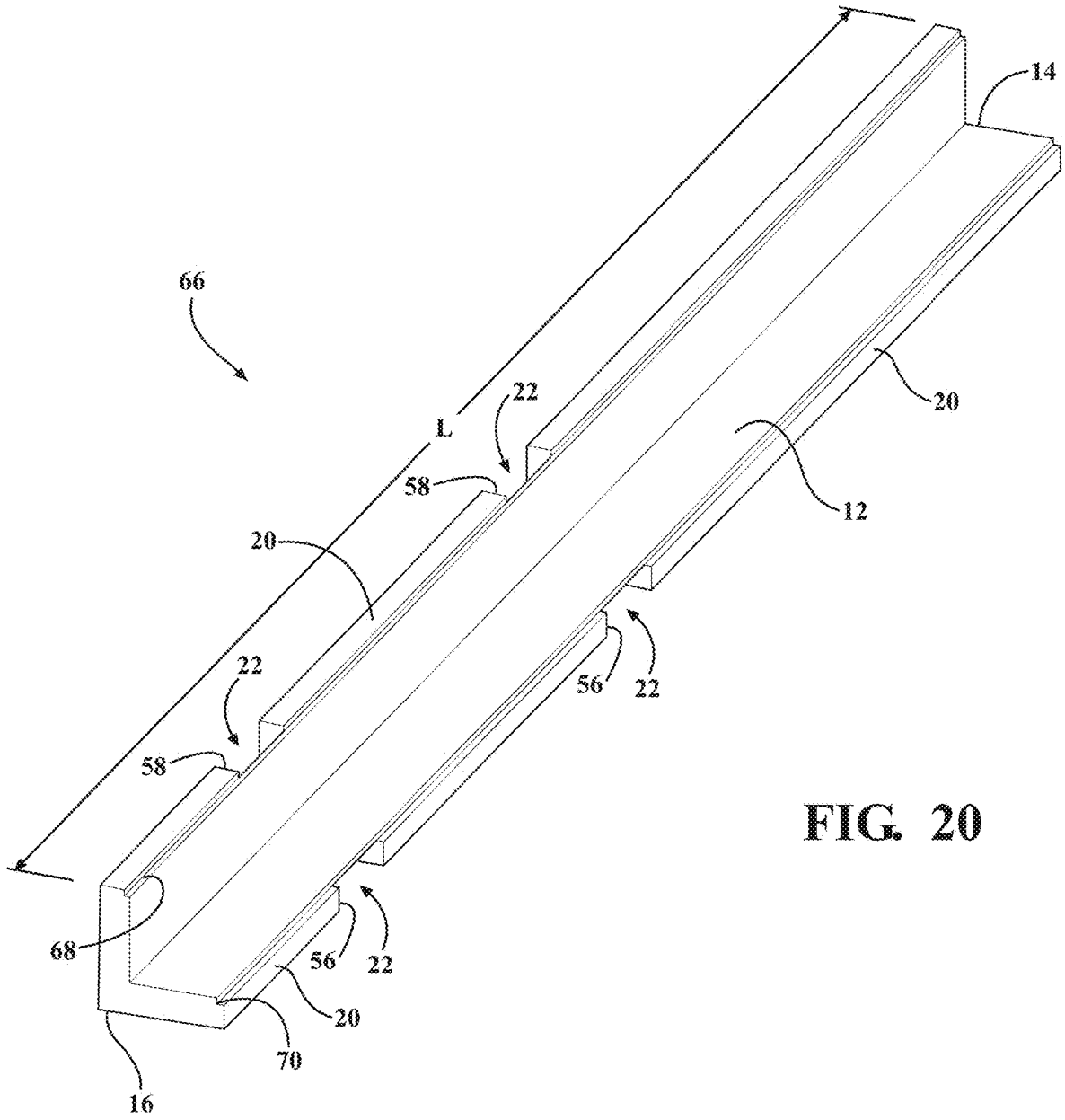
FIG. 20 is a perspective view of an alternative corner sub-assembly.
Figure 21:
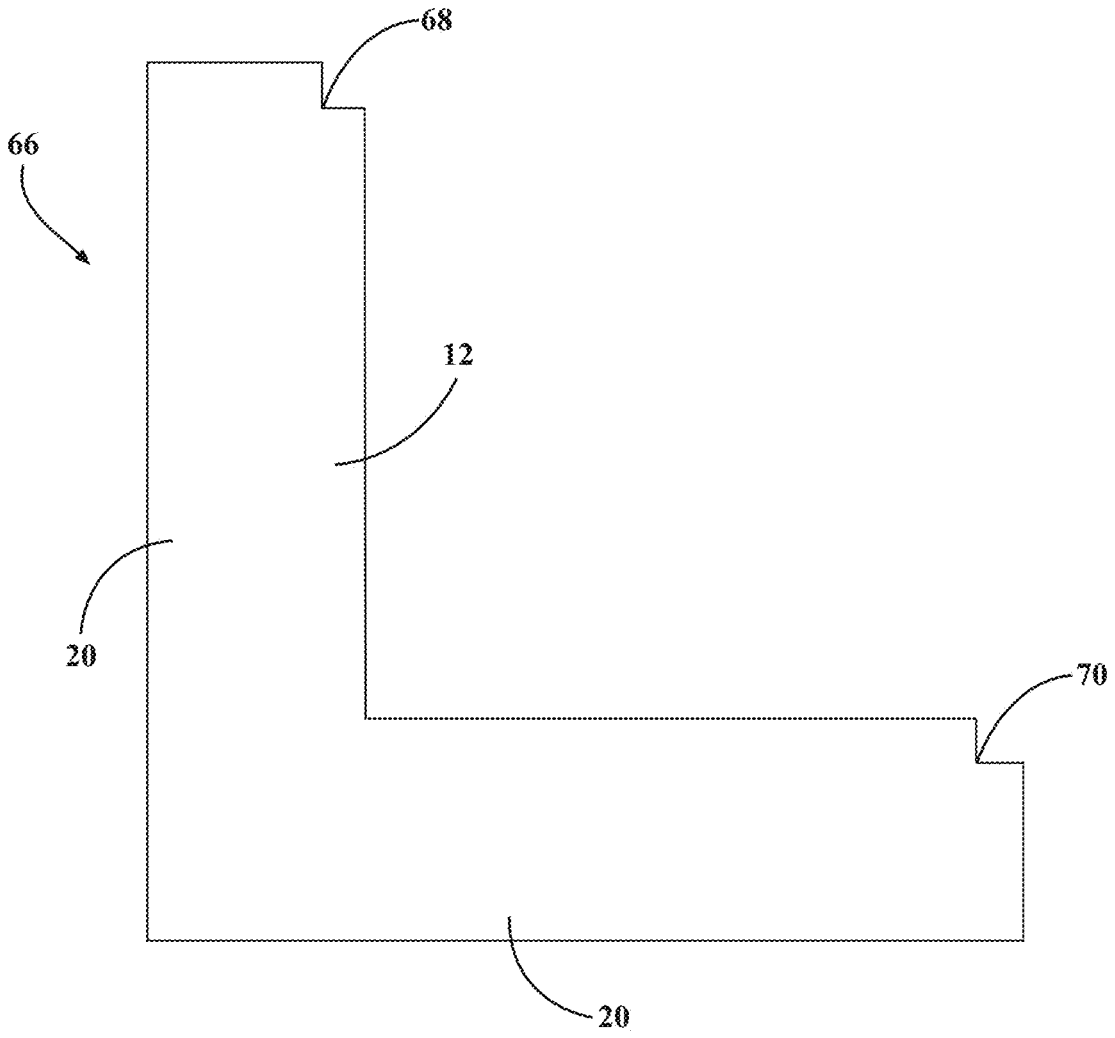
FIG. 21 is a top view of the alternative corner sub-assembly.

Turning to FIGS. 20 and 21, alternatively, the corner pads 20 disposed on each corresponding corner protector could be done in a unitary or integrally formed fashion to create a unitary corner sub-assembly 66. In other words, the corner protector 12 and its corner pads 20 made be made or formed as a single unit. Similar to the corner sub-assembly 18, the unitary corner sub-assembly 66 may be installed about the cargo 11. The unitary corner sub-assembly 66 also has the same first and second end 14, 16 and the same or similar gaps formed along the length thereof to define any suitable number of mounting portions. The unitary corner sub-assembly 66 includes a first unitary corner 68 and a second unitary corner 70. The first and second unitary corner 68, 70 are a result of the corner pads 20 being integrally formed with the corner protectors 12. In certain implementations, the unitary corner sub-assembly 66 may be formed from a foam, such as an EPS foam.

Turning back to FIGS. 2-7, the protective packaging assembly 10 further includes at least one reinforcement bar 26 disposed in one of the gaps 22 and in direct contact with the mounting portion 24 of a corresponding corner protector 12. Said differently, the at least one reinforcement bar 26 may physically touch a specific area of the corresponding corner protector 12, which is the mounting portion 24. The at least one reinforcement bar 26 may include a first reinforcement bar 28 and a second reinforcement bar 30. The first and second reinforcement bars 28, 30 are disposed in the one or more gaps 22. The protective packaging assembly 10 may use the first and second reinforcement bars 28, 30 on different sides of the cargo 11. For example, one side of the cargo 11 may use the first reinforcement bar 28 and another side of the cargo 11 may use the second reinforcement bar 30. It should be appreciated that the opposite sides of the cargo 11 may use the same reinforcement bars 28, 30. For example, the cargo 11 may have four sides, wherein two sides of the cargo 11 use the first reinforcement bar 28 opposite each other and the other two sides of the cargo 11 use the second reinforcement bars 30 opposite each other. The first reinforcement bar 28 may be longer than the second reinforcement bar 30. The first reinforcement bar 28 may be shorter than the second reinforcement bar 30. The first reinforcement bar 28 may be the same length as the second reinforcement bar 30. In some instances, it is advantageous to have different lengths for the first and second reinforcement bars 28, 30 to accommodate a multitude of cargo 11 shapes and sizes. It should be appreciated that the at least one reinforcement bar 26 may include three or more reinforcement bars 26. As previously mentioned, the protective packaging assembly 10 may include the total of sixteen gaps 22, which can accommodate eight reinforcement bars 28, 30 mounted within the gaps 22 of the plurality of corner protectors 12. In certain implementations the at least one reinforcement bar 26 comprises wood.

The protective packaging assembly 10 further includes the first reinforcement bar 28 disposed in the first gap 56 and in direct contact with the first mounting portion 60 and the second reinforcement bar 30 disposed in the second gap 58 and in direct contact with the second mounting portion 62. The protective packaging assembly 10 also includes the first and second gaps 56, 58 aligned on the corresponding corner protector 12 such that the first and second bars 28, 30 are aligned. In certain implementations the reinforcement bars 28, 30 may have an interference fit with the one or more gaps 22, where sides of the reinforcement bars 28, 30 abut the corner pads 20 when installed on the corner protector 12. In another implementation the one or more gaps 22 may be larger than the reinforcement bars 28, 30. For example, when the one or more gaps 22 is larger than the reinforcement bars 28, 30, there may be a space between the reinforcement bars 28, 30 and the corner pads 20.

Figure 10:
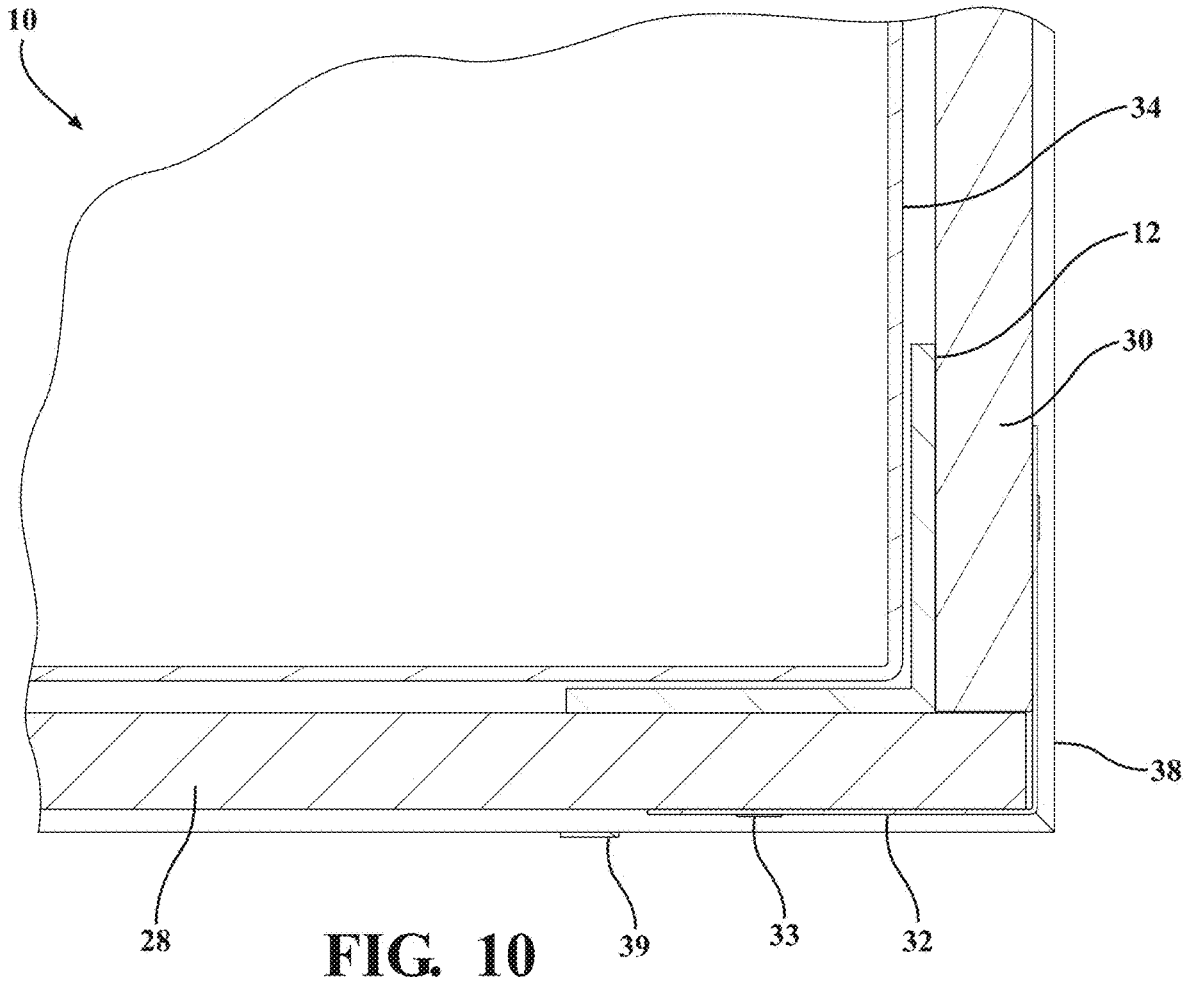
FIG. 10 is a fragmented enlarged view of the protective packaging assembly taken about section 10 of FIG. 9.

In certain implementations when the first and second reinforcement bars 28, 30 are disposed in the gaps 22, the first and second reinforcement bars 28, 30 abut each other. More specifically, an end of the first reinforcement bar 28 abuts a face of the second reinforcement bar 30 as shown in FIG. 10. Said differently, the first and second reinforcement bars 28, 30 are disposed in the gaps 22 in direct contact with the first and second mounting portions 60, 62, and the end of the first reinforcement bar 28 is in direct contact with the face of the second reinforcement bar 30 such that an angle is formed. In another implementation an end of the second reinforcement bar 30 abuts a face of the first reinforcement bar 28. In yet another implementation, the first and second reinforcement bars 28, 30 may have angles at their respective ends. For example, the respective ends of the first and second reinforcement bars 28, 30 may have a forty-five-degree angle and when they are joined, the first and second reinforcement bars 28, 30 form a corner. It should be noted that the first and second reinforcement bars 28, 30 may have angles greater than or less than forty-five degrees at their respective ends such that when they are joined, the first and second reinforcement bars 28, 30 form a corner.

As shown in FIGS. 14-19, the at least one reinforcement bar 26 is disposed within the gap 22 of the one or more gaps 22 and is flush with the plurality of corner pads 20. A benefit of having the reinforcement bars 28, 30 being flush with the plurality of corner pads 20 enhances the protection of the cargo 11 by ensuring that the cargo 11 is held in place and reduce movement of the components of the protective packaging assembly 10. Another benefit of the flushness aspect is the improved space efficiency. For example, the protective packaging assembly 10 having the flush exterior may take up less space than the protective packaging assembly 10 having an irregular exterior in that same space. Another benefit of the flushness aspect is an ease of handling. For example, the protective packaging assembly 10 having the flush exterior handles and stack better than the protective packaging assembly 10 that has an irregular exterior. Also, another benefit of the flushness aspect may be cost savings. For example, the protective packaging assembly 10 having the rigid exterior may require additional cushioning material to prevent damage but the protective packaging assembly 10 with the flush exterior may not require the additional material. Although the at least one reinforcement bar 26 is depicted as flush with the plurality of corner pads 20, the at least one reinforcement bar 26 may also protrude, extending outward, beyond a thickness of the corner pads 20.

As shown FIGS. 1, 8-10 and 16-19, the protective packaging assembly 10 includes at least one corner plate 32 mounted to the first reinforcement bar 28 and the second reinforcement bar 30. The at least one corner plate 32 mounts to an exterior of the first and second reinforcement bars 28, 30 by fasteners 33. One half of the at least one corner plate 32 mounts to the first reinforcement bar 28 and the other half of the at least one corner plate 32 mounts to the second reinforcement bar 30. Each half of the at least one corner plate 32 receives at least one fastener 33. Said differently, the at least one corner plate 32 uses two fasteners 33. The at least one corner plate 32 prevents the first and second reinforcement bars 28, 30 from coming out of the one or more gaps 22. The at least one corner plate 32 may include more than one corner plate 32. It will be appreciated by one skilled in the art that the corner plate 32 may conform to the shape of the corner protector 12. For example, the corner protector 12 may be curved so the corner protector 12 may be curved. In certain implementations, the protective packaging assembly 10 may be assembled without the use of the corner plate 32. Fasteners may be used to couple the first and second reinforcement bars 28, 30 directly to each other. Said differently, the fasteners may be driven through one reinforcement bar and directly into another reinforcement bar. For example, a screw may be driven through the first reinforcement bar 28 and into the second reinforcement bar 30 to couple the first and second reinforcement bars 28, 30.

As shown in FIGS. 1, 8 and 13-19, the protective packaging assembly 10 may include a sleeve 34 disposed between the plurality of corner protectors 12. The sleeve 34 surrounds the cargo 11, adding a layer of protection from damage. The sleeve 34 may be a singular unit or the sleeve 34 may comprise multiple parts.

Referring to FIG. 2, the protective packaging assembly 10 includes a top tray 36 and a bottom tray 38, wherein the top tray 36 covers the first end 14 of the plurality of corner protectors 12 for protecting the cargo 11 from damage and the bottom tray 38 covers the second end 16 of the plurality of corner protectors 12 for protecting the cargo 11 from damage. It should be appreciated that the plurality of corner protectors 12 may be adjacent to the top tray 36 and the bottom tray 38. Said differently, the protective packaging assembly 10 may be configured to install the corner sub-assembly 18 without going inside the top and bottom tray 36, 38. For example, the second end 16 of the plurality of corner protectors 12 of the corner sub-assembly 18 may abut the bottom tray 38 and the first end 14 of the corner sub-assembly 18 may abut the top tray 36.

Figure 11:
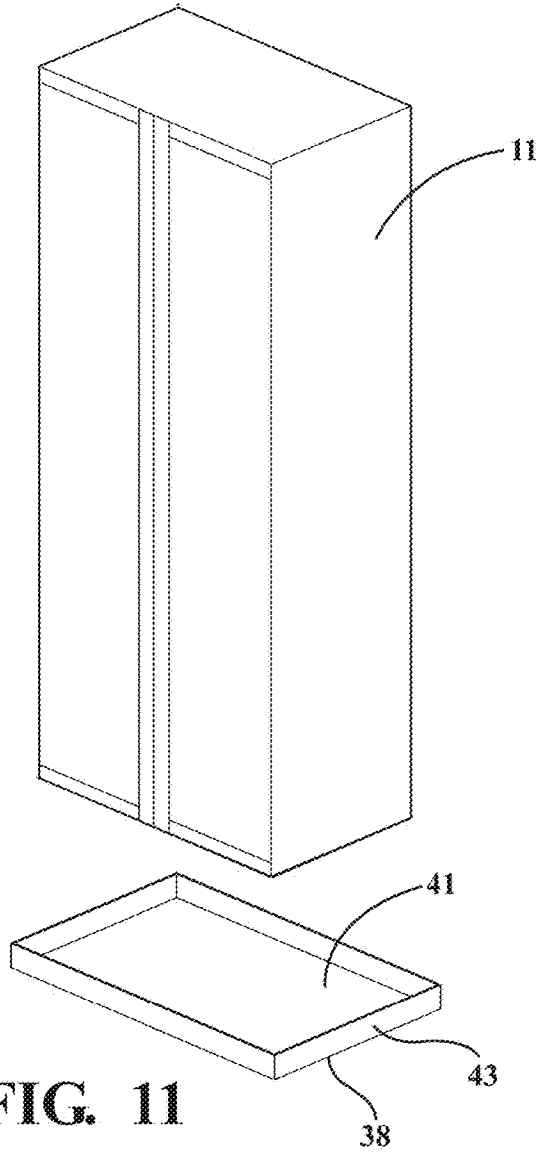
FIG. 11 is a perspective view of a cargo being inserted into a bottom tray of the protective packaging assembly.

As shown in FIG. 11, the bottom tray 38 has a bottom surface 41 and a bottom tray lip 43. The bottom surface 41 receives the cargo 11. The bottom tray lip 43 provides a perimeter to contain the sleeve 34 and the cargo 11. The bottom lip 43 also helps to enclose the second end 16 of the corner sub-assembly 18. Similar to the bottom tray 38, the top tray 36 may have a top lip 45 to contain the cargo 11 and enclose the first end 14 of the corner sub-assembly 18. In certain implementations, the bottom tray 38 may be thicker than the top tray 36 to provide more support for the cargo 11. It should be appreciated that the top tray 36 may be the same size as the bottom tray 38.

Referring to FIGS. 1, 2, 8 and 19, the protective packaging assembly 10 may include at least one strap 39. The at least one strap 39 may further include multiple straps 39. The straps 39 may secure the top and bottom tray 36, 38 to the protective packaging assembly 10. Typically, the straps 39 will wrap around the protective packaging assembly 10 vertically with respect to the bottom tray 38, but the straps 39 may also wrap around the protective packaging assembly 10 horizontally with respect to the bottom tray 38. In certain implementations, the protective packaging assembly 10 may include pallet straps to secure the top and bottom tray 36, 38 to the protective packaging assembly 10. In certain implementations the protective packaging assembly 10 may include a protective cover to add another layer of protection (not shown). The protective covering may be installed underneath the straps 39 or around the straps 39. The protective covering may be made from nylon or another type of plastic.

Figure 8:
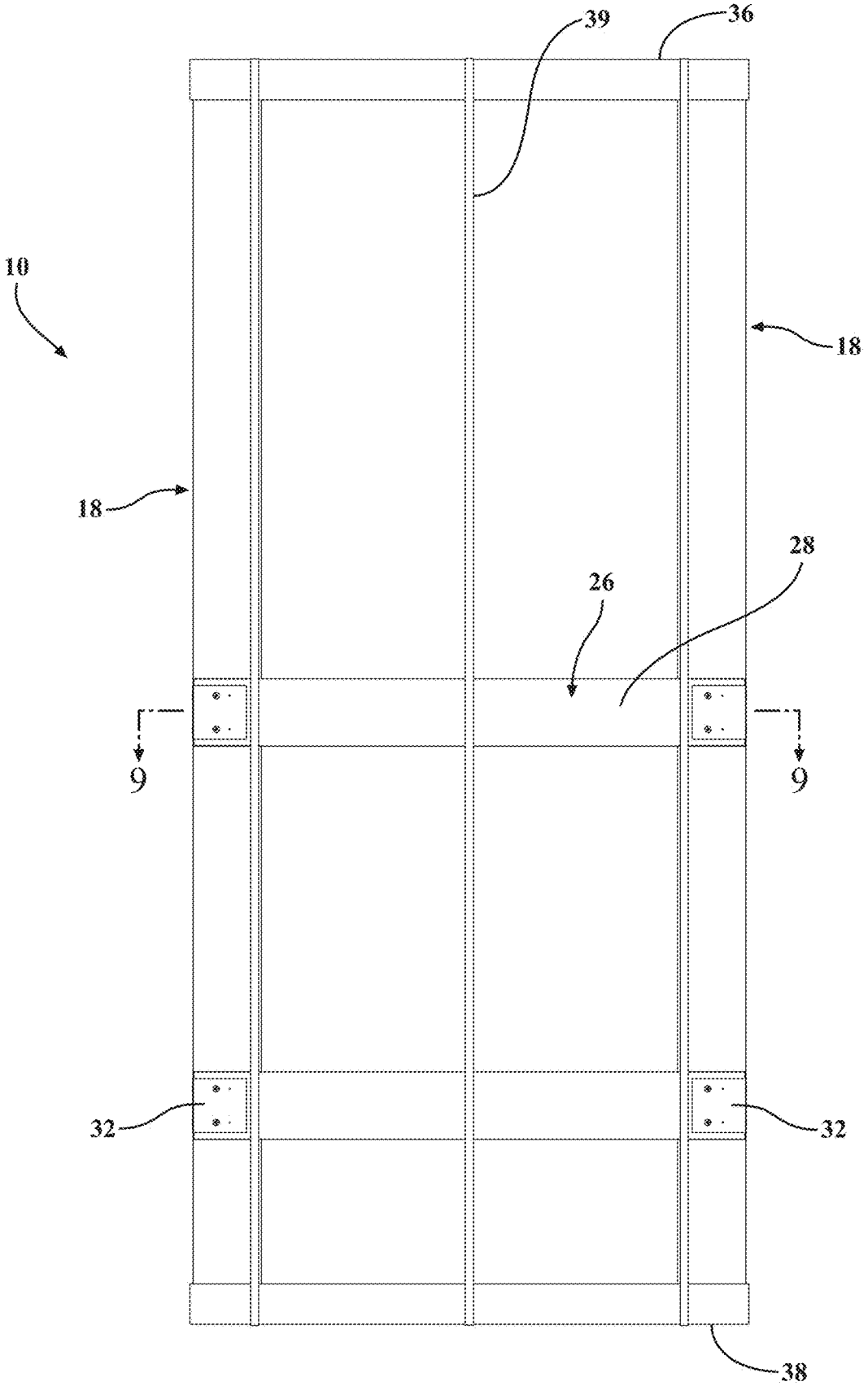
FIG. 8 is an elevation view of the protective packaging assembly.
Figure 9:
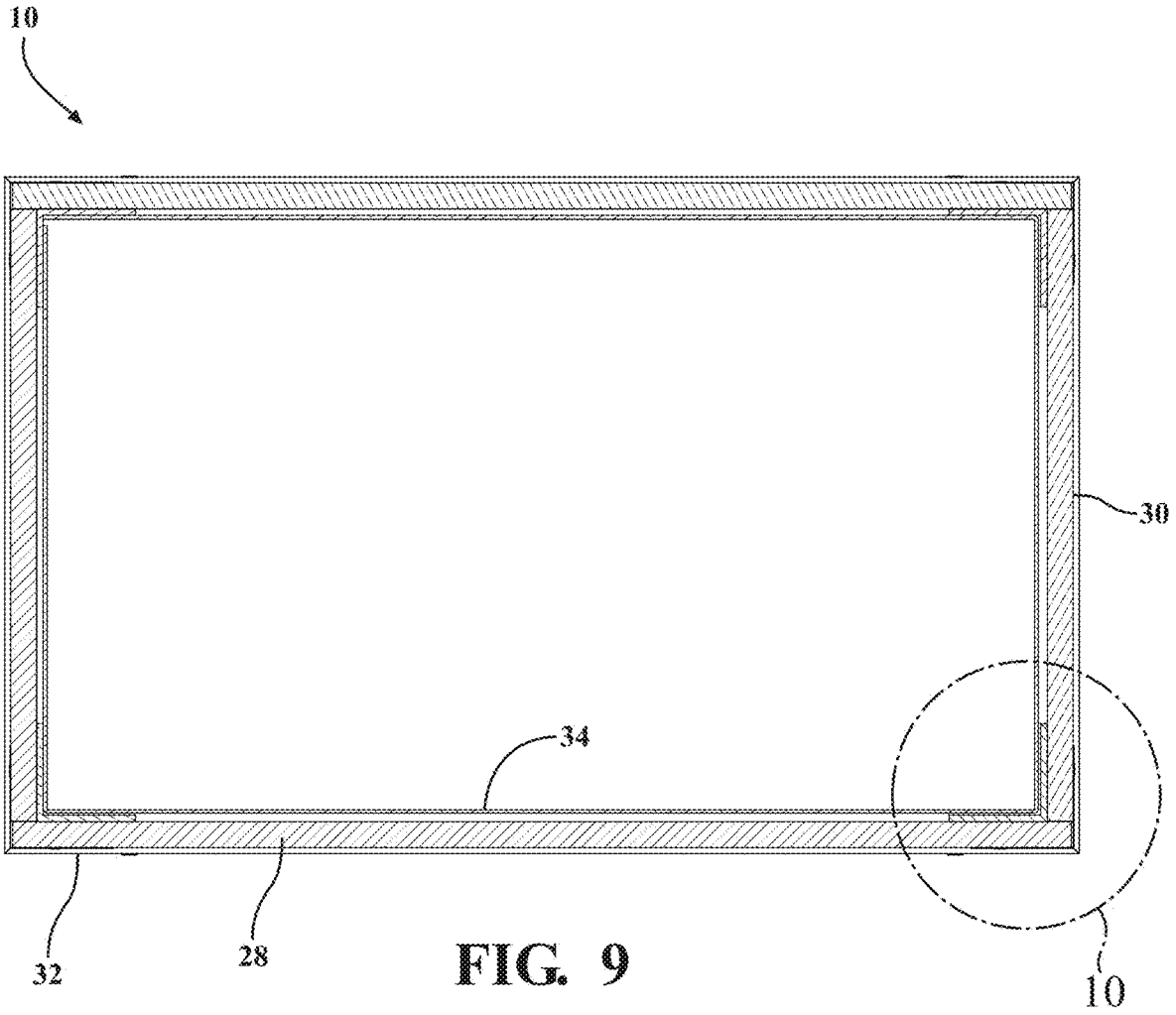
FIG. 9 is a cross-sectional view of the protective packaging assembly taken along a line 9-9 of FIG. 8.

In FIG. 8, the protective packaging assembly 10 is shown with a cross-section taken along an axis 9-9 between the fasteners 33 of the corner plate 32 to reveal the view of FIG. 9. FIG. 9 further shows that the sleeve 34 may be within the perimeter of the top and bottom tray 36, 38. FIG. 10, shows a detailed cross-section of one implantation of the protective packaging assembly 10 fully assembled with the cargo 11. FIG. 10 also shows an alignment of the reinforcement bars 28, 30 as previously mentioned. For illustrative purposes, the sleeve 34 is shown with a slight gap from the corner protector 12. It should be appreciated that when the protective packaging assembly 10 is fully assembled, that the slight gap or space may not be present.

One method of installing the protective packaging assembly 10 to cargo 11 is shown in FIGS. 11-19 and described below. The method includes the protective packaging assembly 10 having the plurality of corner protectors 12, the plurality of corner pads 20 and the at least one reinforcement bar 26. The method may include the steps of positioning the plurality of corner protectors 12 spaced apart from one another about the cargo 11. The method may further include disposing the plurality of corner pads 20 on each corner protector 12 of the plurality of corner protectors 12 to form a corner sub-assembly 18. The plurality of corner pads 20 on each corner protector 12 are spaced from each other to define one or more gaps 22 and to define the mounting portion 24 of the corner protector 12. The method includes mounting the at least one reinforcement bar 26 in one of the gaps 22 and in direct contact with the mounting portion 24 of the corresponding corner protector 12.

As shown in FIG. 11, the method includes positioning the cargo 11 on the bottom tray 38. When the cargo 11 is on the bottom tray 38, the bottom tray lip 43 of the bottom tray 38 covers the perimeter of the cargo 11.

Figure 12:
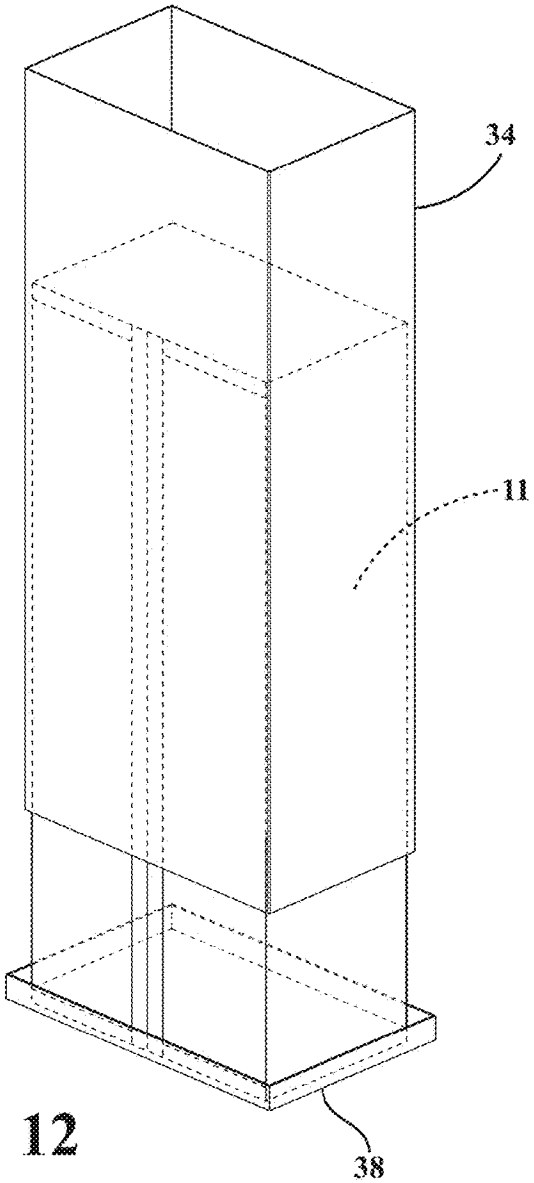
FIG. 12 is a perspective view of the cargo supported by the bottom tray and a sleeve of the protective packaging assembly being disposed over the cargo.

As shown in FIG. 12, the method further comprises the step of at least partially surrounding the cargo 11 with the sleeve 34 prior to positioning the plurality of corner protectors 12 such that the sleeve 34 is disposed between the cargo 11 and the plurality of corner protectors 12. The adhesive or the fastener 33 may be used to fixedly mount the corner pads 20 to the corner protector 12 and then the corner protector 12 is placed against the sleeve. When the sleeve 34 is installed, the sleeve 34 abuts the inside of the bottom tray lip 35 of the bottom tray 38. In certain implementations the sleeve 34 folds around the cargo 11 and then positioned on the bottom tray 38. In certain implementations, the sleeve 34 may be installed in sections where the sections are placed over the cargo 11 one at a time until the sleeve 34 is fully assembled.

Figure 13:
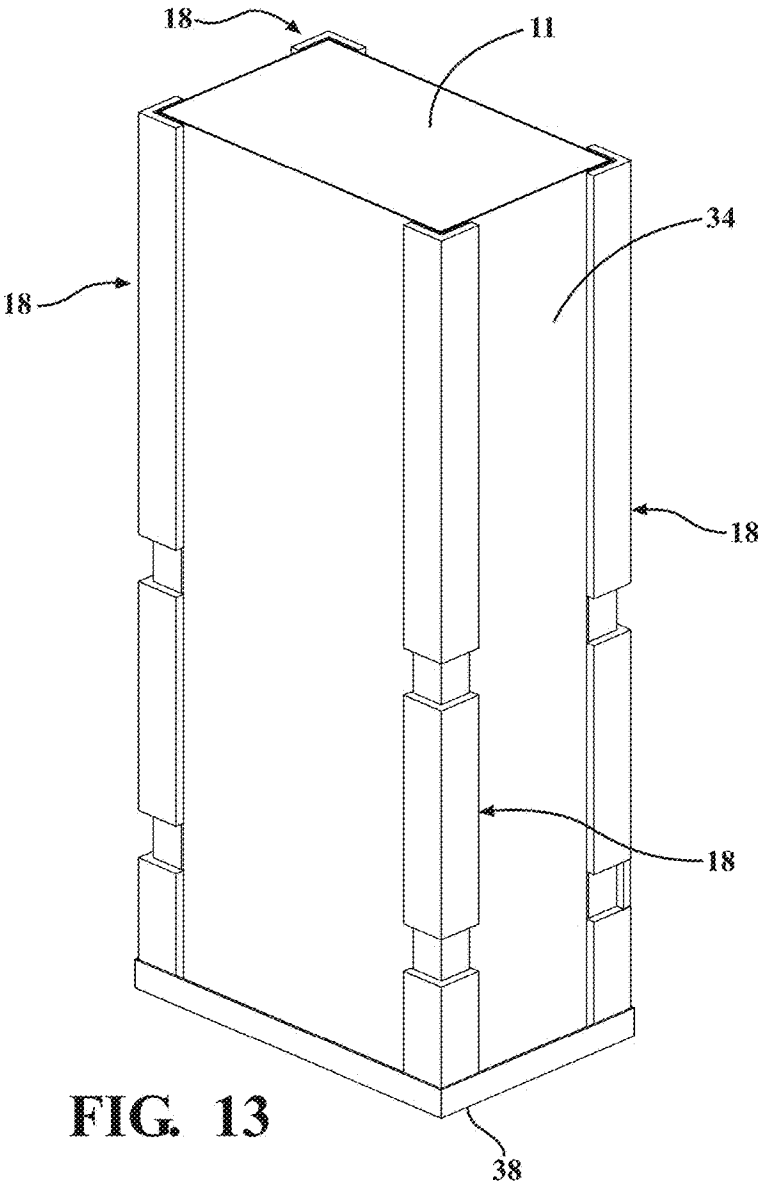
FIG. 13 is a perspective view of the sleeve of the protective packaging assembly disposed about the cargo and a plurality of corner sub-assemblies.

The method may include the step of disposing the plurality of corner pads 20 on each corner protector 12 of the plurality of corner protectors 12 is performed prior to the step of positioning the plurality of corner protectors 12 about the cargo 11 such that the step of positioning the plurality of corner protectors 12 is further defined as positioning a plurality of corner sub-assemblies 18 about the cargo 11. It should be appreciated that the preferred embodiment of the method is to assemble the corner sub-assembly 18 rather than assemble the plurality of corner pads 20 to each corner protector 12 while positioning the corner protector 12 about the cargo 11. It should be appreciated that FIG. 13 schematically represents what the cargo 11 may look like with a plurality of corner sub-assemblies 18.

The step of disposing the plurality of corner pads 20 on each corner protector 12 may be further defined as forming the corner pads 20 with the corner protector 12 to create a unitary corner sub-assembly 66, and the step of positioning the plurality of corner protectors 12 is performed after the unitary corner sub-assembly 66 is formed. It should be appreciated that the unitary sub-assembly 66 is used similarly to the corner sub-assemblies 18. Additionally, the protective packaging assembly 10 may use more than one unitary sub-assembly 66.

Figure 14:
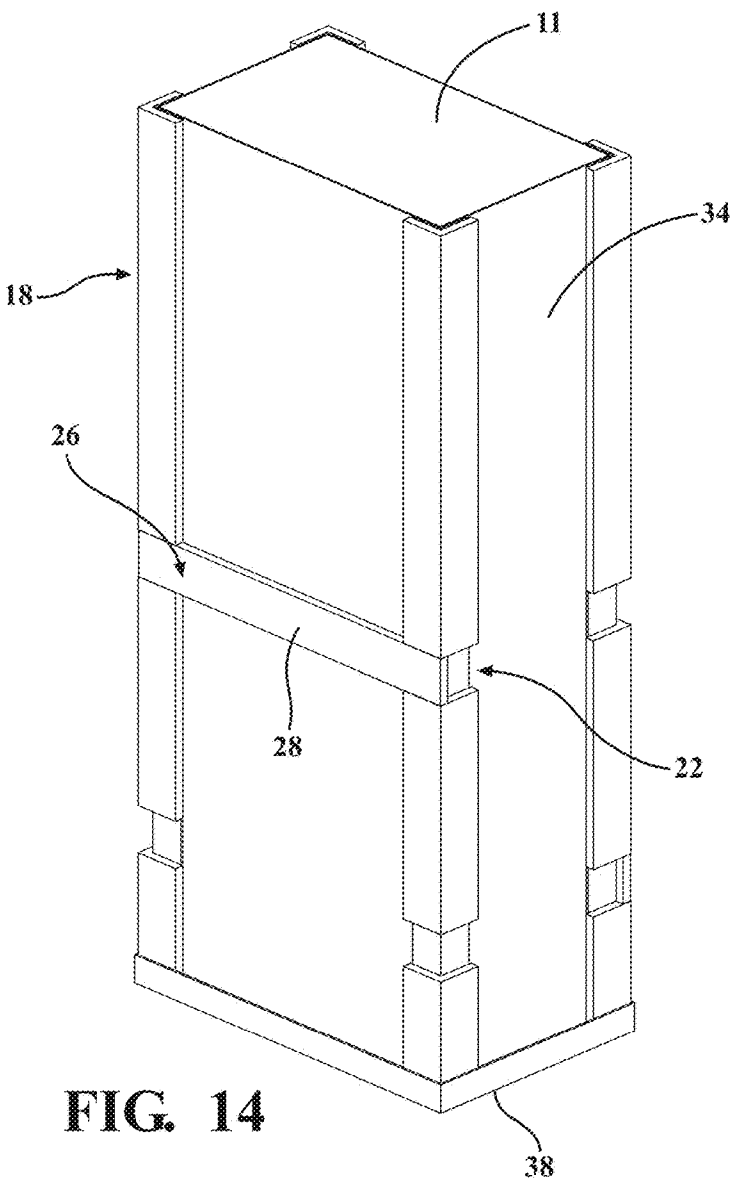
FIG. 14 is a perspective view of the sleeve disposed about the cargo and a first reinforcement bar of the protective packaging assembly mounted to two of the corner sub-assemblies.

As shown in FIG. 14, the method also includes mounting the at least one reinforcement bar 26 in one of the gaps 22 and in direct contact with the mounting portion 24 of a corresponding corner protector 12. It should be appreciated that the reinforcement bars 28, 30 may have an interference fit with corner pads 20, which allows the reinforcement bars 28, 30 to stay positioned in the gaps 22 during assembly.

Figure 16:
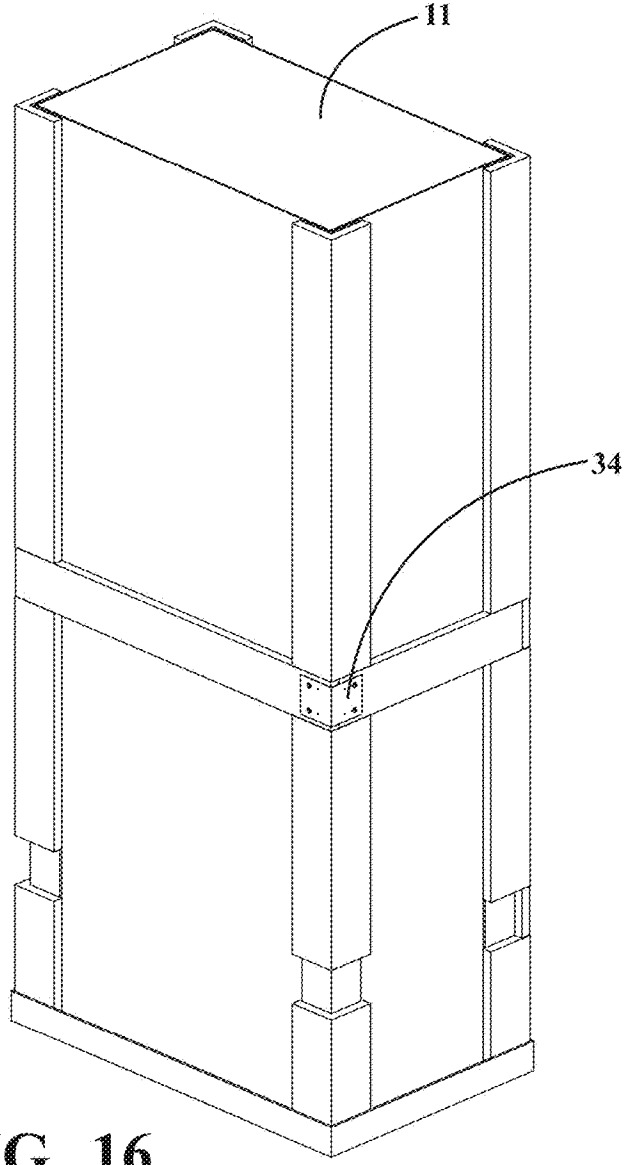
FIG. 16 is a perspective view of the sleeve disposed about the cargo with a corner plate of the protective packaging assembly coupled to the first reinforcement bar and the second reinforcement bar.
Figure 15:
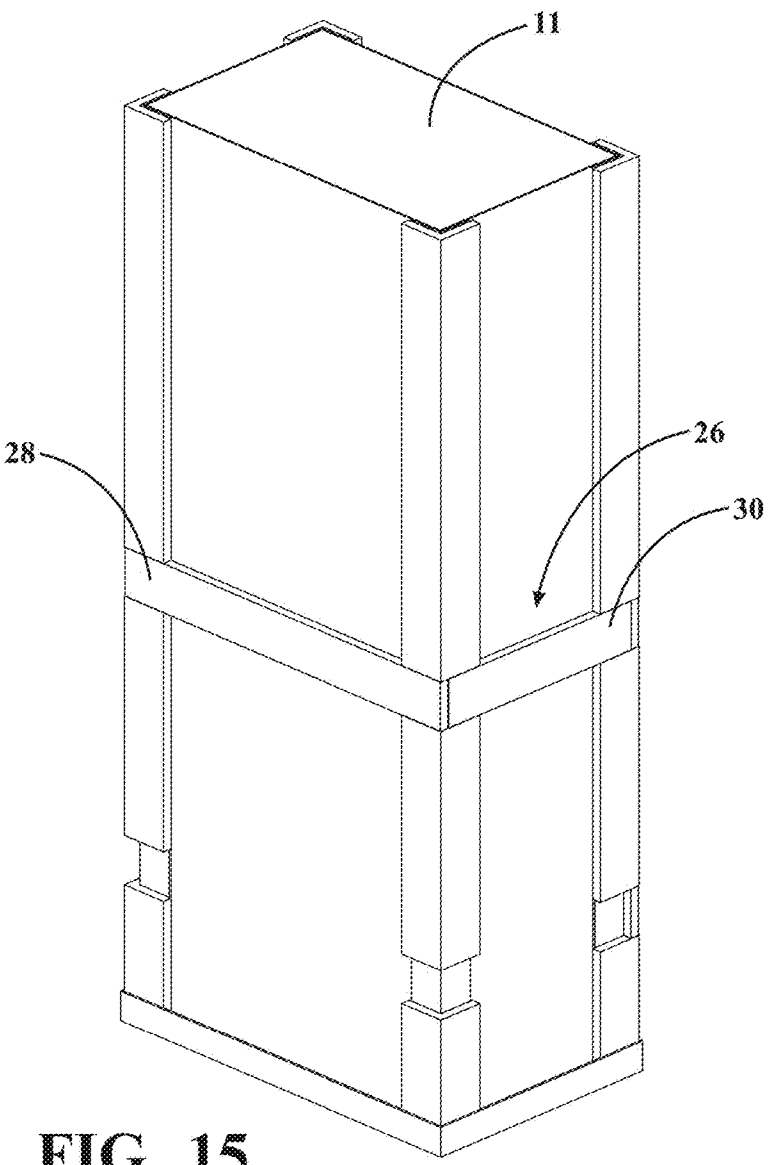
FIG. 15 is a perspective view of the sleeve disposed about the cargo with a second reinforcement bar of the protective packaging assembly mounted to the plurality of corner sub-assemblies.
Figure 18:
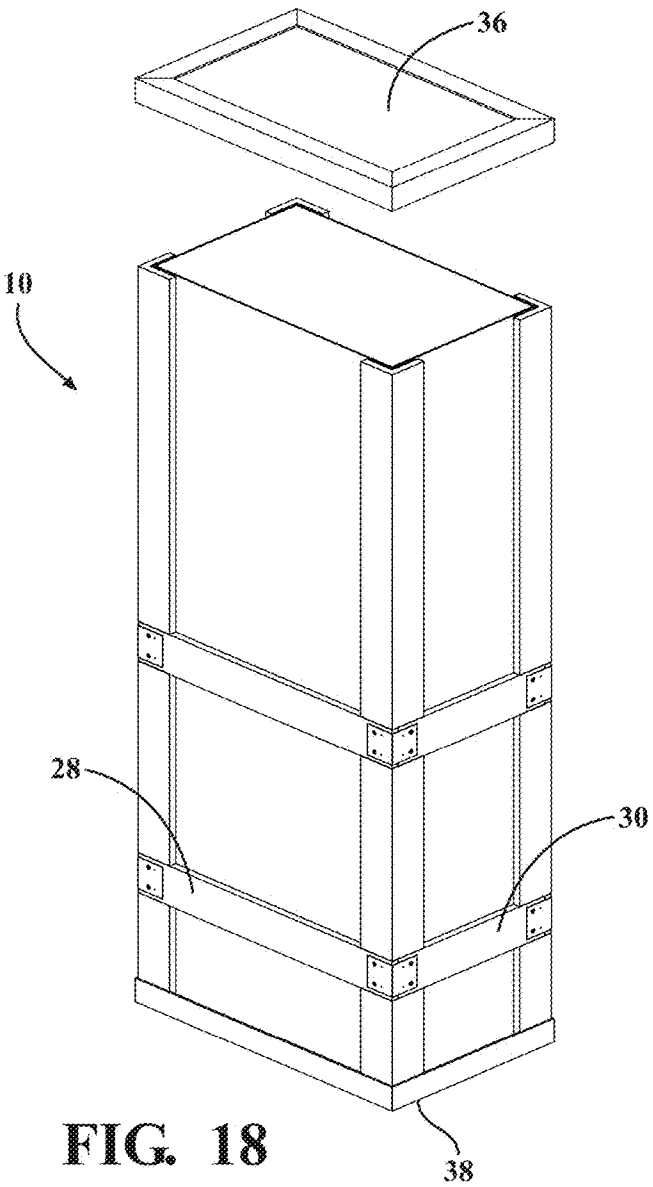
FIG. 18 is a perspective view of the sleeve disposed about the cargo receiving a top tray of the protective packaging assembly.
Figure 17:
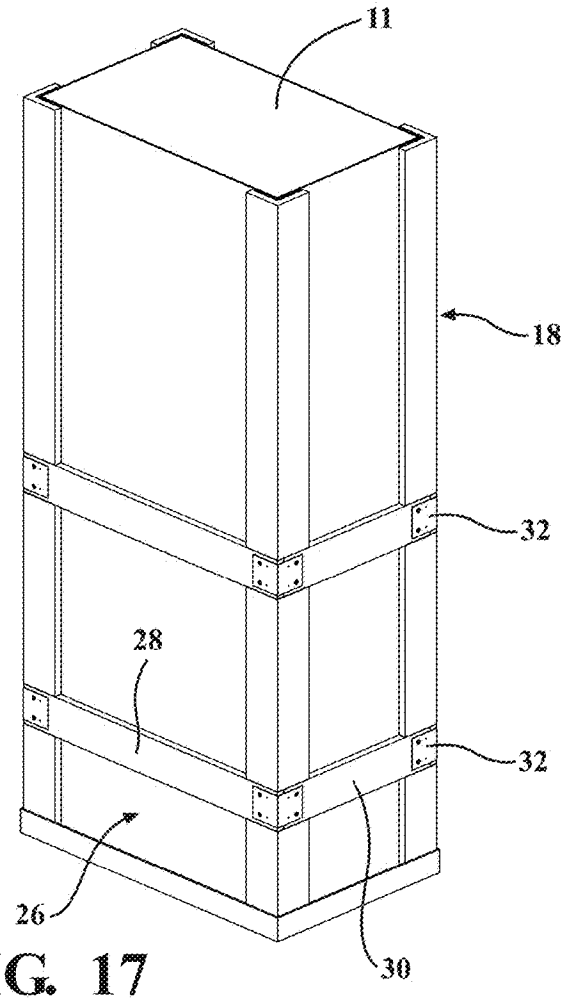
FIG. 17 is a perspective view of the sleeve disposed about the cargo with a plurality of corner plates coupling four reinforcement bars mounted to a plurality of corner sub-assemblies.
Figure 19:
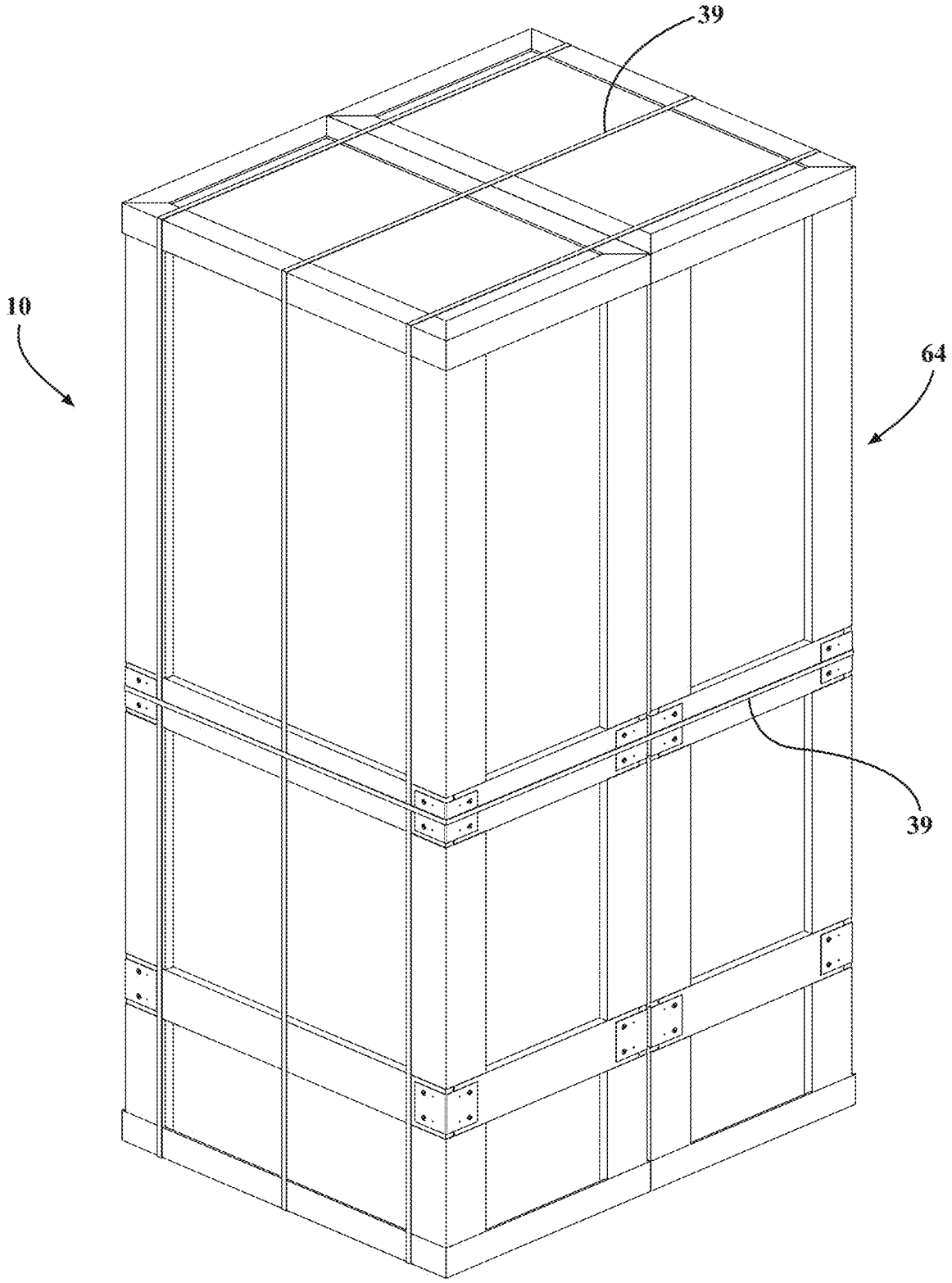
FIG. 19 a perspective view of the protective packaging assembly bundled to a second protective packaging assembly.

As shown in FIG. 16, the method includes the step of mounting the corner plate 32 to the first reinforcement bar 28 and the second reinforcement bar 30. Fasteners 33 are used to couple the corner plate 32 to the first reinforcement bar 28 and the second reinforcement bar 30. One skilled in the art will appreciate that a person or people installing the corner sub-assemblies 18 may install the reinforcement bars 28, 30 in pairs along the corner sub-assembly 18 as shown in FIG. 15, which may make installing the corner plate 32 easier. As shown in FIGS. 1, 8 and 17-19, multiple corner plates 32 may be used to complete coupling the multiple reinforcements bars 28, 30. The method may include the step of mounting the at least one reinforcement bar 26 flush with the plurality of corner pads 20.

As shown in FIGS. 1, 2, 8 and 19, the method may include installing straps 39. When the straps 39 are installed, the bottom tray 38 may be placed on top of the straps 39 before the cargo 11 is positioned in the bottom tray 38 to easily tie the straps 39 without lifting the protective packaging assembly 10, after the protective packaging assembly 10 is completed. The method may include lifting the protective packaging assembly 10 when fully assembled and then tying the straps 39. In certain implementations, the protective packaging assembly 10 may be coupled to a second protective packaging assembly 64 with the straps 39. In certain implementations the protective covering may be installed before the straps 39 are tied. It should be noted that the protective covering may be installed after the straps 39 are tied.

Several implementations have been discussed in the foregoing description. However, the implementations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A protective packaging assembly for protecting cargo from damage during transport or handling, the protective packaging assembly comprising:

a plurality of corner protectors spaced apart from one another with each corner protector having a first end, a second end, and a length therebetween;

a plurality of corner pads disposed on to each corner protector of the plurality of corner protectors along the length to form a corner sub-assembly with the plurality of corner pads on each corner protector being spaced from each other to define one or more gaps along the length of each corner protector to define a mounting portion of the corner protector; and at least one reinforcement bar disposed in one of the gaps and in direct contact with the mounting portion of a corresponding corner protector.

2. The protective packaging assembly of claim 1, wherein the plurality of corner pads are fixedly mounted to each corner protector to maintain the one or more gaps.

3. The protective packaging assembly of claim 1, wherein the plurality of corner pads are mounted to each corner protector by an adhesive.

4. The protective packaging assembly of claim 1, wherein the plurality of corner pads are integrally formed with the corner protector to create a unitary corner sub-assembly.

5. The protective packaging assembly of claim 1, wherein the at least one reinforcement bar is disposed within a gap of the one or more gaps and is flush with the plurality of corner pads.

6. The protective packaging assembly of claim 1, wherein the at least one reinforcement bar is further defined as a first reinforcement bar and a second reinforcement bar and further comprising at least one corner plate mounted to the first reinforcement bar and the second reinforcement bar.

7. The protective packaging assembly of claim 1, wherein the at least one reinforcement bar is further defined as a first reinforcement bar and a second reinforcement bar and wherein the one or more gaps is further defined as a first gap and a second gap to define a first mounting portion and a second mounting portion on a corresponding corner protector with the first reinforcement bar disposed in the first gap and in direct contact with the first mounting portion and the second reinforcement bar disposed in the second gap and in direct contact with the second mounting portion wherein the first and second gaps are aligned on the corresponding corner protector such that the first and second bars are aligned.

8. The protective packaging assembly of claim 1, wherein the at least one reinforcement bar is further defined as having a first reinforcement bar and a second reinforcement bar, wherein the first reinforcement bar is longer than the second reinforcement bar.

9. The protective packaging assembly of claim 1, wherein each corner protector of the plurality of the corner protectors includes a first panel coupled to a second panel angled to form a corner.

10. The protective packaging assembly of claim 9, wherein each corner pad of the plurality of corner pads includes a first portion disposed on the first panel and a second portion disposed on the second panel.

11. The protective packaging assembly of claim 10, wherein the first portion of the corner pads includes a first inner face and the second portion of the corner pads includes a second inner face with the first inner face abutting the second inner face to form an interior of each corner pad of the plurality of corner pads, wherein the interior of each corner pad of the plurality of the panels of corner pads are disposed on an exterior of the plurality of corner protectors.

12. The protective packaging assembly of claim 1, further comprising a top tray and a bottom tray, wherein the top tray covers a first end of a plurality of corner sub-assemblies for protecting the cargo from damage and the bottom tray covers a second end of the plurality of corner sub-assemblies for protecting the cargo from damage.

13. The protective packaging assembly of claim 1, wherein the plurality of corner protectors are further defined as four corner protectors with the plurality of corner pads further defined as three pads for each corner protector such that four gaps extend along the length of each corner protector to define a total of sixteen gaps and further including eight reinforcement bars mounted within the gaps of the plurality of corner protectors.

14. The protective packaging assembly of claim 1, further comprising a sleeve disposed between the plurality of corner protectors.

15. The protective packaging assembly of claim 1, wherein the plurality of corner pads are comprised of honeycomb cardboard and the plurality of corner protectors comprises compressed cardboard.

16. The protective packaging assembly of claim 1, wherein the at least one reinforcement bar comprises wood.

17. A method of installing a protective packaging assembly cargo with the protective packaging assembly having a plurality of corner protectors, a plurality of corner pads and at least one reinforcement bar, the method comprising the steps of:

positioning the plurality of corner protectors spaced apart from one another about the cargo;

disposing the plurality of corner pads on each corner protector of the plurality of corner protectors to form a corner sub-assembly with the plurality of corner pads on each corner protector being spaced from each other to define one or more gaps and to define a mounting portion of the corner protector; and mounting the at least one reinforcement bar in one of the gaps and in direct contact with the mounting portion of a corresponding corner protector.

18. The method of claim 17, wherein the protective packaging assembly further comprises a sleeve and the method further comprises the step of at least partially surrounding the cargo with the sleeve prior to positioning the plurality of corner protectors such that the sleeve is disposed between the cargo and the plurality of corner protectors.

19. The method of claim 17, wherein the step of disposing the plurality of corner pads on each corner protector of the plurality of corner protectors is performed prior to the step of positioning the plurality of corner protectors about the cargo such that the step of positioning the plurality of corner protectors is further defined as positioning a plurality of corner sub-assemblies about the cargo.

20. The method of claim 17, wherein the step of disposing the plurality of corner pads on each corner protector is further defined as forming the corner pads with the corner protector to create a unitary corner sub-assembly, and the step of positioning the plurality of corner protectors is performed after the unitary corner sub-assembly is formed.

21. The method of claim 17, wherein the step of mounting the at least one reinforcement bar in one of the gaps is further defined as mounting the at least one reinforcement bar flush with the plurality of corner pads.

22. The method of claim 17, wherein the at least one reinforcement bar includes a first reinforcement bar and a second reinforcement bar and wherein the protective packaging assembly further comprises a corner plate, the method further comprises the step of mounting the corner plate to the first reinforcement bar and the second reinforcement bar.

* * * * *